US008508372B2

(12) United States Patent
Cuddihy

(10) Patent No.: US 8,508,372 B2
(45) Date of Patent: Aug. 13, 2013

(54) METHOD AND SYSTEM FOR FALL DETECTION

(75) Inventor: Paul Edward Cuddihy, Ballston Lake, NY (US)

(73) Assignee: General Electric Company, Niskayuna, NY (US)

( * ) Notice: Subject to any disclaimer, the term of this patent is extended or adjusted under 35 U.S.C. 154(b) by 490 days.

(21) Appl. No.: 12/819,260

(22) Filed: Jun. 21, 2010

(65) Prior Publication Data

US 2011/0313325 A1 Dec. 22, 2011

(51) Int. Cl.
*G08B 23/00* (2006.01)

(52) U.S. Cl.
USPC ..... 340/573.1; 600/595

(58) Field of Classification Search
USPC ..... 340/573.1; 600/595
See application file for complete search history.

(56) References Cited

U.S. PATENT DOCUMENTS

| | | | | |
|---|---|---|---|---|
| 7,612,666 | B2 | 11/2009 | Badawy | |
| 7,978,084 | B2 * | 7/2011 | Dixon et al. | 340/573.1 |
| 2003/0010345 | A1 | 1/2003 | Koblasz et al. | |
| 2003/0058341 | A1 | 3/2003 | Brodsky et al. | |
| 2006/0001545 | A1 | 1/2006 | Wolf | |
| 2006/0055543 | A1 | 3/2006 | Ganesh et al. | |
| 2006/0089538 | A1 | 4/2006 | Cuddihy et al. | |
| 2006/0145874 | A1 * | 7/2006 | Fredriksson et al. | 340/573.1 |
| 2009/0278934 | A1 | 11/2009 | Ecker et al. | |

FOREIGN PATENT DOCUMENTS

| | | | |
|---|---|---|---|
| FR | 2870378 | A1 | 11/2005 |
| WO | 9305627 | A1 | 3/1993 |
| WO | WO 03/027977 | * | 4/2003 |
| WO | 03091961 | A1 | 11/2003 |
| WO | 2004047039 | A1 | 6/2004 |

OTHER PUBLICATIONS

Search Report from corresponding EP Application No. 11169827.0-2215 dated Sep. 6, 2011.

Zhengming Fu, Eugenio Culurciello, Patrick Lichtsteiner and Tobi Delbruck; "Fall Detection using an Address-Event Temporal Contrast Vision Sensor"; IEEE International Symposium on Circuits and Systems (ISCAS 2008), May 18-21, 2008; pp. 424-427.

* cited by examiner

*Primary Examiner* — Max Hindenburg
*Assistant Examiner* — Renee Danega
(74) *Attorney, Agent, or Firm* — Marie-Claire B. Maple

(57) ABSTRACT

A method and system for detecting motion is described. A data acquisition system is positioned at a desired position by establishing a reference line based on the desired position of the data acquisition system. Further, a field of view of the data acquisition system is partitioned into an upper region and a lower region based on the reference line. Subsequently, motion information corresponding to a person in the field of view is acquired. Additionally, it is determined if the acquired motion information corresponds to the upper region and/or the lower region in the field of view. Moreover, a magnitude of motion and an area of motion of the person are computed using the acquired motion information. Subsequently, a motion event corresponding to the person in the lower region of the field of view is detected based on the determined magnitude of motion and the determined area of motion.

27 Claims, 4 Drawing Sheets

METHOD AND SYSTEM FOR FALL DETECTION

BACKGROUND

Embodiments of the present technique relate generally to computer vision applications, and more particularly to video based fall detection.

Unintentional falls are one of the most complex and costly health issues facing elderly people. Recent studies show that approximately one in every three adults age 65 years or older falls each year, and about 30 percent of these falls result in serious injuries. Particularly, people who experience a fall event at home may remain on the ground for an extended period of time as help may not be immediately available. The studies indicate a high mortality rate amongst such people who remain on the ground for an hour or more after a fall.

Fall detection (FD), therefore, has become a major focus of healthcare facilities. Conventionally, healthcare facilities employ nursing staff to monitor a person around the clock. In settings such as assisted living or independent community life, however, the desire for privacy and the associated expense render such constant monitoring undesirable. Accordingly, several techniques have been introduced to effectively monitor and detect fall events. These techniques may be broadly classified into four categories—embedded sensor based FD systems, community or social alarm based FD systems, acoustic sensor-based FD systems and video sensor based FD systems.

The embedded sensor based FD systems may typically entail use of physical motion sensors such as accelerometers and gyroscopes. Similarly, the social alarm based FD systems may use a wearable device such as a medallion or a wristwatch that includes a pushbutton. Such sensor based and social alarm based FD systems may be successful only if the individual wears the motion sensing devices at all times and is physically and cognitively able to activate the alarm when an emergency arises. Further, the acoustic based FD systems may include microphones that may be used to detect falls by analyzing frequency components of vibrations caused by an impact of a human body with the ground. However, the acoustic based FD systems are best suited for detecting heavy impacts and may be less useful in situations where a resident has slid out of a chair or otherwise become stuck on the floor without a rapid decent and heavy impact.

Accordingly, in recent times, video based systems are being widely investigated for efficient fall detection. The video based FD systems process images of the person's motion in real time to evaluate if detected horizontal and vertical velocities corresponding to the person's motion indicate a fall event. Only a portion of falls, however, is heavy falls having high horizontal and vertical velocities. The remaining falls, characterized by low horizontal and vertical velocities, thus, may not be robustly detected by the video based FD systems. Further, determination of the horizontal and vertical velocities while detecting human falls involves use of complex computations and classification algorithms, thereby requiring higher processing power and expensive equipment. The computations become even more complicated when data from multiple video acquisition devices positioned at various positions in an FD environment is used for fall detection. Conventional video-based FD systems, thus, fail to provide cost effectiveness or ease of implementation.

Moreover, use of such video based FD systems typically involves acquisition of personally identifiable information leading to numerous privacy concerns. Specifically, constant monitoring and acquisition of identifiable videos may be considered by many people to be an intrusion of their privacy.

It may therefore be desirable to develop an effective system and method for detecting high-risk movements, especially human fall events. Additionally, there is a need for a relatively inexpensive FD system that may be easily mounted for effectively detecting the fall events in a wide area with a fairly low instance of false alarms. Further, it may be desirable for the FD system to be able to adapt to different configurations of objects and furniture disposed in the wide area, while non-intrusively yet reliably detecting a wide variety of falls.

BRIEF DESCRIPTION

In accordance with aspects of the present technique, a method for detecting motion is presented. The method includes positioning a data acquisition system at a desired position and establishing a reference line based on the desired position of the data acquisition system. Further, a field of view of the data acquisition system may be partitioned into an upper region and a lower region based on the reference line. Subsequently, motion information corresponding to a person in the field of view of the data acquisition system may be acquired. Additionally, it may be determined if the acquired motion information corresponds to the upper region, the lower region, or a combination thereof, in the field of view of the data acquisition system. Further, a magnitude of motion and an area of motion of the person may be computed using the acquired motion information. Finally, a motion event corresponding to the person in the lower region of the field of view of the data acquisition system may be detected based on the determined magnitude of motion and the determined area of motion of the person.

In accordance with another aspect of the present technique, a fall detection system is described. The fall detection system may include a data acquisition system that acquires a plurality of pixels that experiences a change in a corresponding parameter in a field of view of the data acquisition system and corresponds to a person. Further, the fall detection system may include a positioning subsystem that positions the data acquisition system at a desired position and establishes a reference line based on the desired position of the data acquisition system. The fall detection system may also include a processing subsystem communicatively coupled to the data acquisition system. The processing subsystem may partition a field of view of the data acquisition system into an upper region and a lower region based on the reference line. Further, the processing subsystem may acquire motion information corresponding to the person in the field of view of the data acquisition system. Additionally, the processing subsystem may also determine if the acquired motion information corresponds to the upper region and/or the lower region in the field of view of the data acquisition system. Accordingly, the processing subsystem may compute a magnitude of motion and an area of motion of the person using the acquired motion information. Finally, the processing subsystem may detect a fall event corresponding to the person in the field of view of the data acquisition system based on the determined magnitude of motion and the determined area of motion of the person.

DRAWINGS

These and other features, aspects, and advantages of the present technique will become better understood when the following detailed description is read with reference to the accompanying drawings in which like characters represent like parts throughout the drawings, wherein.

DETAILED DESCRIPTION

The following description presents systems and methods for fall detection. Particularly, the embodiments illustrated herein describe systems and methods for detecting motion of an object, such as a person, proximate a ground level. In certain other embodiments, the systems and methods may further determine if the detected motion of the object corresponds to a fall event. Although the present system is described with reference to human fall detection, the system may be used in many different operating environments for detecting a fallen object that continues to move subsequent to a fall. By way of example, the fallen object may include a moving toy, a pet, and so on. An exemplary environment that is suitable for practicing various implementations of the present technique is described in the following sections with reference to FIGS. 1-2.

Figure 1:
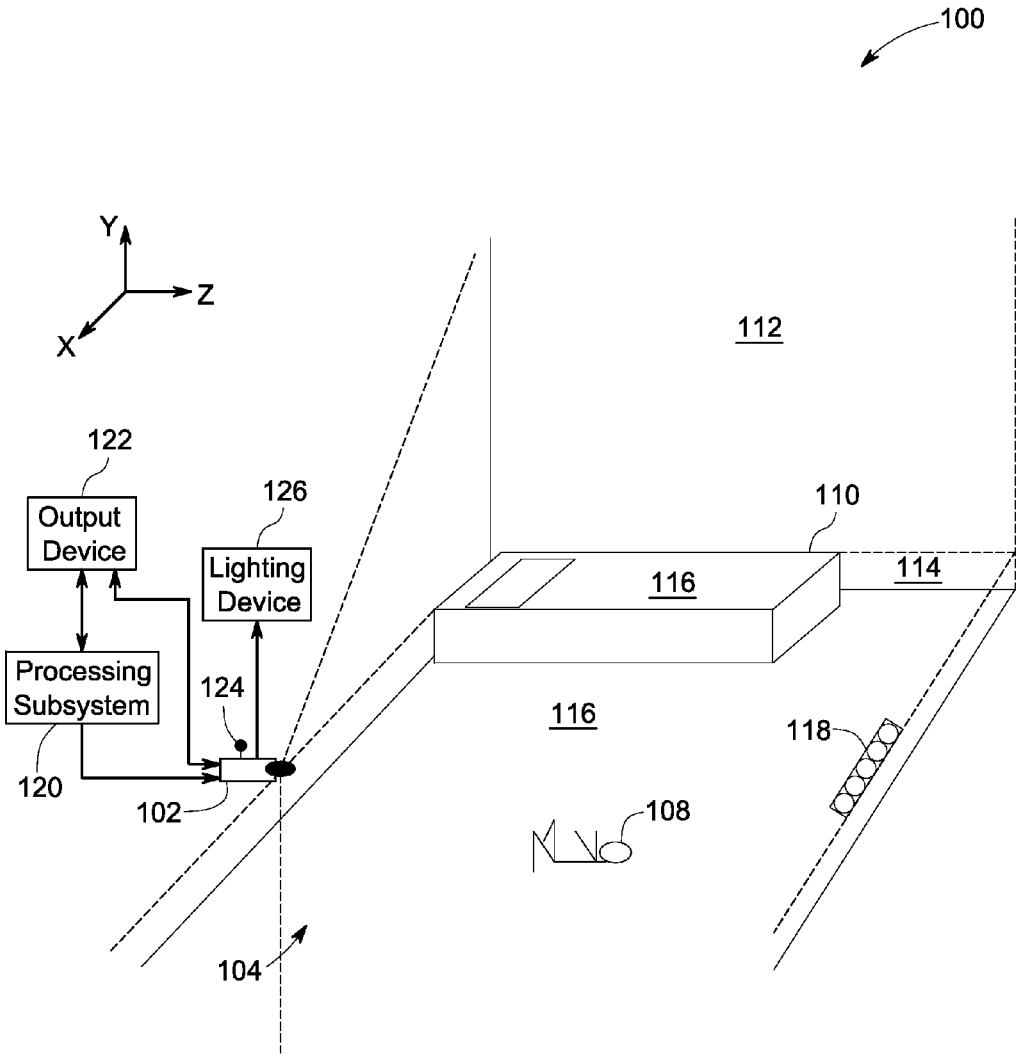
FIG. 1 is a block diagram of an exemplary environment for an FD system, in accordance with aspects of the present system.

FIG. 1 illustrates an exemplary system 100 for fall detection. In one embodiment, the FD system 100 may include a data acquisition system (DAS) 102 for monitoring a field of view 104. By way of example, the field of view 104 may include a floor 106 of a room in front of the DAS 102, a portion of the room and/or the entire room. Particularly, the DAS 102 may monitor the field of view 104 for detecting motion events corresponding to an object, such as a person 108 disposed in the field of view 104. To that end, the DAS 102 may include a video camera, an infrared camera, a standard camera, a temporal contrast vision camera, or other suitable type of imaging device. In certain embodiments, the DAS 102 may further include a wide-angle lens for capturing large areas of the field of view 104 reliably and cost effectively. Further, in certain embodiments, the DAS 102 may specifically monitor relevant regions of the field of view 104 where a risk associated with a potential fall event may be high. The DAS 102, therefore, may appropriately be positioned at a desired position to effectively monitor the relevant regions of the field of view 104.

In accordance with aspects of the present technique, the desired position of the DAS 102 may correspond to a desired height and a desired orientation of the DAS 102. By way of example, the desired height may correspond to a waist height of a person, such as about 24 inches above the ground level. Alternatively, the desired height of the DAS 102 may be based on application requirements, such as size of the object to be monitored and/or dimensions corresponding to the field of view 104. By way of example, the desired height of the DAS 102 may be adjusted such that regions including furniture such as a bed or chair are designated as low-risk regions in the field of view. Similarly, the desired orientation may be adjusted to enable the DAS 102 to effectively monitor relevant regions of the field of view 104. To that end, the desired orientation of the DAS 102 may correspond to a vertical orientation or a horizontal orientation.

Specifically, in one embodiment, a reference line 110 may be established at the desired height and the desired orientation of the DAS 102 to ensure appropriate positioning of the DAS 102. Further, the reference line 110 may partition the field of view 104 into an upper region 112 and a lower region 114 for detecting fall events corresponding to the person 108 in the field of view 104. By way of example, the lower region 114 may correspond to one or more regions in the field of view 104 where a risk associated with a potential fall event corresponding to the person 108 may be high. The lower region 114, therefore, may correspond to the regions such as foot of a bed 116, a ground or the floor 106 of the room, whereas the upper region 112 may correspond to the rest of the room.

The reference line 110, thus, may be established such that a substantial portion of high-risk movements such as the person 108 crawling into the room or twitching on the floor 106 may be confined to the lower region 114. Alternatively, the reference line 110 may be established at a waist height of a person, such as about 24 inches above the floor 106. The reference line 110 may be established at such a height to avoid false alarms by ensuring that at least a portion of the low-risk movements corresponding to a person lying on the bed 116 or sitting in a chair is detected in both the upper region 112 and the lower region 114. Accordingly, in certain embodiments, the reference line 110 may be established such that the upper region 112 and the lower region 114 are substantially equal in size. In other embodiments, however, the reference line 110 may be established such that the size of the upper region 112 and the lower region 114 differ substantially based on application requirements, such as size of the person 108 to be monitored and dimensions corresponding to the FD system 100.

Although FIG. 1 illustrates the field of view 104 to be a horizontal plane, a reference line may similarly be established to partition a field of view of the DAS 102 into an upper region and a lower region when the field of view corresponds to a vertical plane or an inclined plane.

Figure 2:
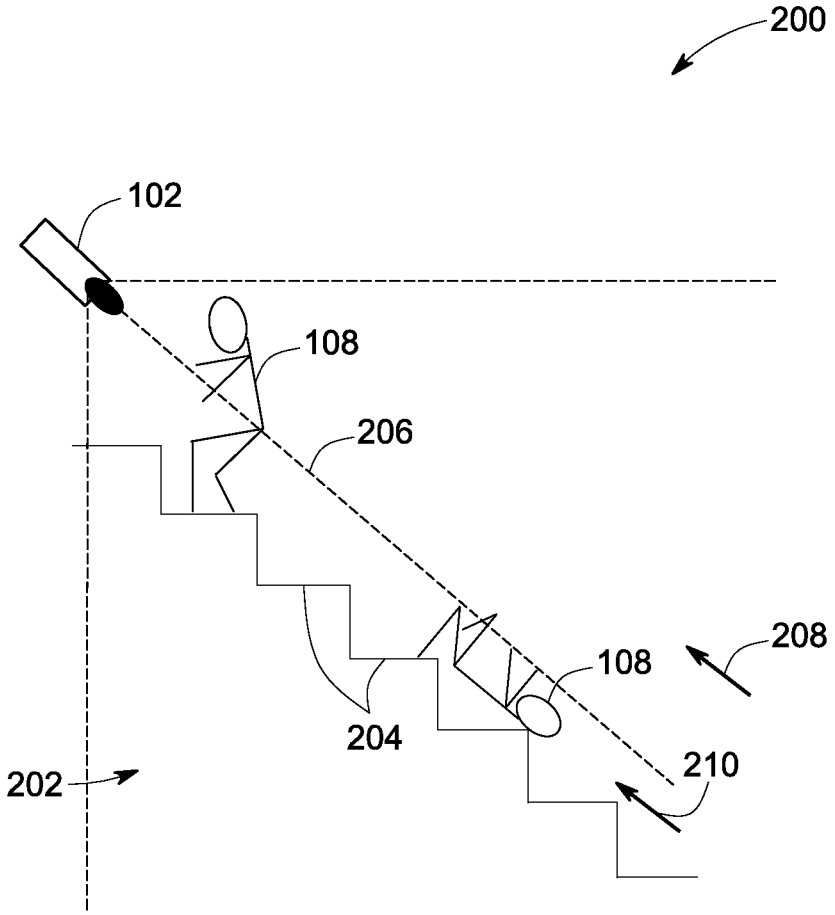
FIG. 2 is a block diagram of another exemplary environment including an inclined plane for an FD system, in accordance with aspects of the present system.

FIG. 2 illustrates an FD system 200, where a field of view 202 of the DAS 102 corresponds to an inclined plane, such as a flight of stairs 204. In such an embodiment, a reference line 206 may partition the field of view 202 into an upper region 208 and a lower region 210. Particularly, the reference line 206 may partition the field of view 202 such that a substantial portion of the movements indicative of a potential fall event corresponding to the person 108 may be confined to the lower region 210 proximate the base of the flight of stairs 204.

Further, with returning reference to FIG. 1, a specific installation procedure may be employed to establish the reference line 110 based on the desired position of the DAS 102. In one embodiment, a reference device 118 may be disposed at the desired height and the desired orientation of the DAS 102 for establishing the reference line 110. To that end, the reference device 118 may include a light emitting diode, reflective tape, a flashing strip of lights, reflectors, and so on. Based on certain specific characteristics of the reference device 118 such as a height and/or an orientation corresponding to the flashing strip of lights, the DAS 102 may easily detect one or more pixels corresponding to the reference device 118.

Particularly, the DAS 102 may determine a horizontal row of pixels corresponding to the reference device 118 to be indicative of a threshold value of the desired height and/or the desired orientation of the reference device 118. In one embodiment, the threshold value corresponds to a determined range of desirable positions in the field of view 104 within which the DAS 102 may be positioned to effectively monitor the upper region 112 and the lower region 114. In another embodiment, the reference device 118 disposed at the desired height and the desired orientation of the DAS 102 may emit a low power visible laser light. The height of the visible laser light on an opposite wall may be determined to be generally indicative of the desired height and the desired orientation of the DAS 102.

In order to determine the height of the visible laser light and facilitate other pixel processing functions, the DAS 102 may operatively be coupled to a processing subsystem 120 through wired and/or wireless network connections (not shown). To that end, the processing subsystem 120 may include one or more microprocessors, microcomputers, microcontrollers, and so forth. The processing subsystem 120, in one embodiment, may further include memory such as RAM, ROM, disc drive or flash memory for storing information such as a current position of the DAS 102, the threshold value of the desired height and the desired orientation of the DAS 102, and so on. Specifically, the processing subsystem 120 may compare a current position of the DAS 102 with the threshold value of the desired height and the desired orientation of the DAS 102 to determine if the DAS 102 is appropriately positioned.

If the current position of the DAS 102 differs from the threshold value by more than a determined value, the processing subsystem 120 may generate an output through an output device 122 coupled to the DAS 102 and/or the processing subsystem 120. This output may include an audio output and/or a visual output such as flashing lights, display messages and/or an alarm. To that end, the output device 122 may include an alarm unit, an audio transmitter, a video transmitter, a display unit, or combinations thereof, to generate the audio output and/or the video output. Additionally, the output device 122 may generate and/or communicate an output signal through a wired and/or wireless link to another monitoring system for indicating the undesirable positioning of the DAS 102.

In certain embodiments, the DAS 102 may further include a positioning subsystem 124 for adjusting the current position of the DAS 102 in accordance with the desired position upon receiving the generated output. Specifically, in one embodiment, the positioning subsystem 124 may include one or more fastening devices such as screws for adjusting a current height and/or a current orientation of the DAS 102. Alternative embodiments of the positioning subsystem 124, however, may include one or more actuators such as levers or gimbals/servos operatively coupled to the processing subsystem 120 to automatically adjust the position of the DAS 102 based on the generated output and/or information received from the processing subsystem 120. The positioning subsystem 124, thus, may enable the DAS to be appropriately positioned at the desired position to effectively monitor field of view 104.

Upon being appropriately positioned, the DAS 102 may acquire one or more images corresponding to the person 108 disposed in the upper region 112, the lower region 114, or a combination thereof, in the field of view 104. In certain embodiments, the DAS 102 may operatively be coupled to a lighting device 126 for ensuring acquisition of good quality images even in low light conditions. Particularly, the DAS 102 may activate the lighting device 126 such as a nightlight upon detecting the lighting conditions in the field of view 104 to be inadequate for imaging the person 108. The lighting device 126, therefore, may be selected to have sufficient power for enabling the DAS 102 to acquire one or more clear images of the person 108.

Further, the processing subsystem 120 may process the one or more images of the person 108 to generate a list of one or more pixels corresponding to the person 108. Specifically, the processing subsystem 120 may identify a list of recently changed pixels corresponding to the person 108. As used herein, the term "recently changed pixels" may correspond to one or more pixels corresponding to the person 108 that experience a change in a corresponding parameter over a determined time period. By way of example, the corresponding parameter may include an X coordinate position, a Y coordinate position, a Z coordinate position, or combinations thereof, of the recently changed pixels in a positional coordinate system corresponding to the field of view 104.

In certain embodiments, the processing subsystem 120 may further determine if there is a continual change in the corresponding parameter associated with each of the recently changed pixels over the determined time period. By way of example, the determined time period may correspond to about 30-120 seconds when using the DAS 102 such as a standard camera having a standard frame rate of about 30 Hz and positioned at a distance of about 10 meters from the floor 106. Alternatively, the determined time period may be based on the user preferences and/or application requirements to ensure efficient detection of motion events in the field of view 104. In accordance with aspects of the present technique, the nature and duration of change in the corresponding parameter experienced by the recently changed pixels in the determined time period may be indicative of a motion event corresponding to the person 108.

Accordingly, the processing subsystem 120 may analyze the nature and duration of the change in the corresponding parameter experienced by the recently changed pixels to acquire motion information corresponding to the person 108. The processing subsystem 120 may also determine if the acquired motion information corresponds to the upper region 112, the lower region 114, or a combination thereof. Specifically, the processing subsystem 120 may use the acquired motion information for computing characteristics that facilitate detection of the potential fall events corresponding to the person 108. These characteristics may include a magnitude of motion, a location of motion, an area of motion of the person 108 in the upper region 112 and/or the lower region 114 of the field of view 104, and so on. The computations of the magnitude of motion and the area of motion of the person 108 will be described in greater detail with reference to FIGS. 3-4.

Further, the computed values corresponding to the magnitude of motion and the area of motion of the person 108 may be used to determine a plurality of FD parameters. In one embodiment, the FD parameters may include an approximate size of the person 108, a distance of the person 108 from the DAS 102 and a horizontal or a vertical position of the person 108. The processing subsystem 120 may use these FD parameters to detect specific fall events such as a person crawling in from another room, a person twitching on the floor, a slip fall, a slow fall, and so on. By way of example, the processing subsystem 120 may use the magnitude and area of motion to determine if the detected motion corresponds to the person 108. Further, the distance of the person 108 from the DAS 102 and the orientation of the person 108 may indicate if the person is disposed on the floor 108.

In certain embodiments, the processing subsystem 120 may also evaluate a location of each of the recently changed pixels and a duration of the experienced change to detect specific fall events. If the processing subsystem 120 determines that a count of the recently changed pixels is greater than a determined threshold and that the recently changed pixels were initially located in both the upper region 112 and the lower region 114, and subsequently, only in the lower region 114, a slip fall event may be determined. Alternatively, if the recently changed pixels experience a change in a corresponding parameter for more than the determined time period and are disposed only in the lower region 114, a fall event such as a person crawling in from another room or twitching on the floor, or a slow fall event may be determined.

However, if the processing subsystem 120 determines that the recently changed pixels were initially located in the lower region 114, and subsequently within the determined time period, in both the upper region 112 and the lower region 114, no fall event may be determined. In embodiments relating to human fall detection, the determined time period may correspond to a recovery time during which the person may get up subsequent to a fall. Alternatively, the determined time period may also correspond to a time, for example, in which the seated person 108 may be expected to move an arm or upper body part after moving only the feet. By way of example, in one embodiment, the determined time period may be about 90 seconds. The determined period, however, may vary based on other parameters such as a location of the fall and/or the presence of another person in the field of view 104.

Thus, unlike conventional FD applications where determining fall events require complicated speed computations, the processing subsystem 120 employs simple yet robust computations for detecting fall events. Specifically, the processing subsystem 120 may detect the slip fall, the slow fall and/or various other motion events simply by determining the count and location information corresponding to the recently changed pixels in the upper region 112 and the lower region 114 over the determined time period. The determination of the count and location information corresponding to the recently changed pixels is further facilitated by mounting the DAS 102 at the desired height, for example, at a waist height of the person 108. As previously noted, the desired height of the DAS 102 may be easily adjusted using the positioning subsystem 124 for effectively detecting a majority of high-risk movements that typically occur in the lower region 114.

Moreover, the processing subsystem 120 analyzes the recently changed pixels for detecting a potential fall event corresponding to the person 108 in the field of view 104 as opposed to using an entire image of the person 108 as in conventional FD applications. Employing the identified list of the recently changed pixels for fall detection, thus, eliminates the need to store images and/or other personally identifiable information, thereby mitigating privacy concerns.

Further, upon determining that the person 108 has suffered a potential fall, the processing subsystem 120 may generate an output through the output device 122 for alerting appropriate personnel or a monitoring system. As previously noted, the output device 122 may communicate an audio output, a video output, and/or an output signal through a wired or wireless link to another monitoring system to generate a warning or perform any other specified action. By way of example, the specified action may include sounding an alarm, sending a message to a mobile device, flashing lights coupled to an FD system, and so on. The structure and functioning of an FD system in accordance with aspects of the present technique will be described in greater detail with reference to FIGS. 3-4.

Figure 3:
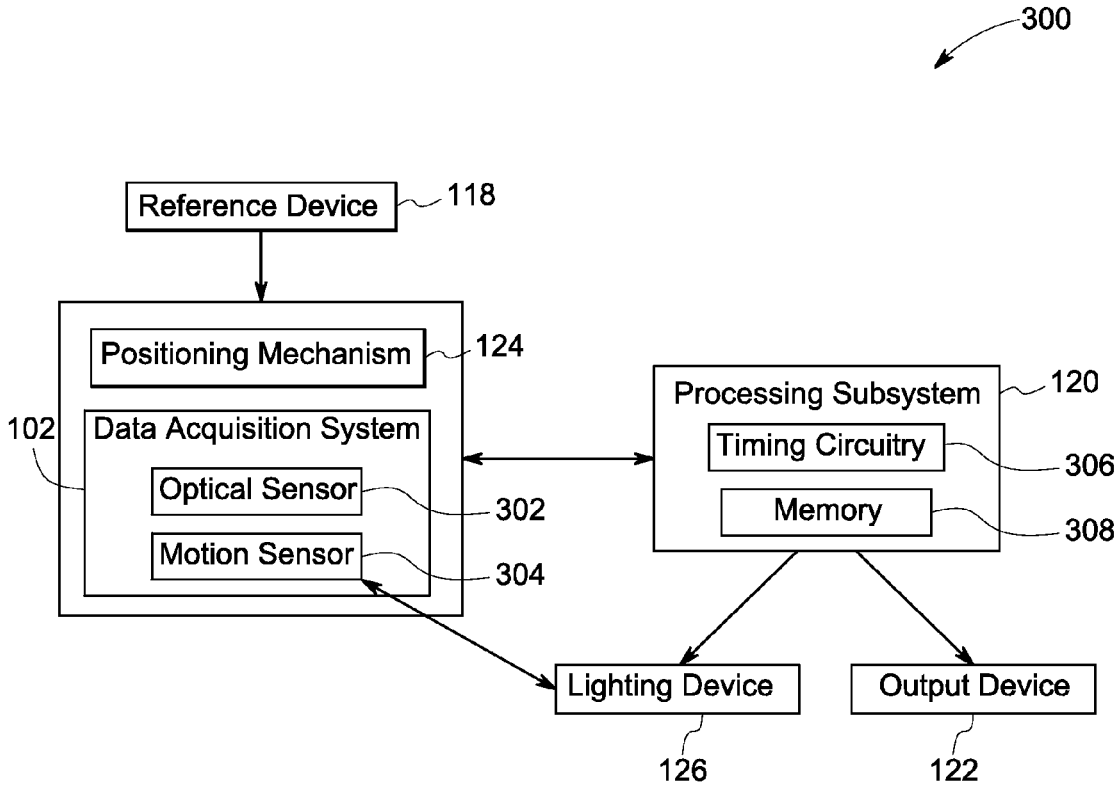
FIG. 3 is a block diagram of the FD system illustrated in FIG. 1, in accordance with aspects of the present system.

FIG. 3 illustrates an exemplary block diagram of a FD system 300, in accordance with aspects of the present technique. For clarity, the FD system 300 is described with reference to the elements of FIG. 1. In one embodiment, the FD system 300 may include the DAS 102 operatively coupled to the processing subsystem 120 of FIG. 1 through a wired and/or wireless connection (not shown). The FD system 300 may further include the reference device 118 and the positioning subsystem 124 of FIG. 1 to facilitate appropriate positioning of the DAS 102 at a desired position. As previously noted, the desired position of the DAS 102 may correspond to a desired height and a desired orientation. By way of example, the desired height may correspond to a waist height of a person, such as about 24-30 inches, whereas the desired orientation of the DAS 102 may correspond to a horizontal orientation.

When appropriately positioned at the desired height and the desired orientation, the DAS 102 may acquire one or more images corresponding to the person 108 disposed in the field of view 104 of FIG. 1. In certain embodiments, the DAS 102 may be further coupled to the lighting device 126 to ensure adequate lighting in the field of view 104 for acquiring good quality images even in inadequate lighting conditions. To that end, the DAS 102 may include an optical sensor 302 to determine if ambient lighting conditions in the field of view 104 are adequate for clearly imaging the person 108. The DAS 102 and/or the processing subsystem 120 may activate the lighting device 126, such as a nightlight or an infrared camera, upon detecting the lighting conditions in the field of view 104 to be inadequate for imaging the person 108. Alternatively, the DAS 102 may include a motion sensor 304 for activating the lighting device 126 upon detecting vibrations indicative of motion events corresponding to the person 108. To that end, the motion sensor 304 may include a passive infrared sensor. Although FIG. 3 illustrates both the optical sensor 302 and the motion sensor 304, in certain embodiments, the exemplary FD system 300 may include either of the optical sensor 302 or the motion sensor 304. Accordingly, either of the optical sensor 302 or the motion sensor 304 may be used to activate the lighting device 126 for ensuring adequate lighting for the DAS 102 to acquire good quality images corresponding to the person 108.

Further, in accordance with aspects of the present technique, the processing subsystem 120 may generate a list of one or more pixels corresponding to the person 108. Particularly, the processing subsystem 120 may identify the recently changed pixels corresponding to the person 108 disposed in the field of view 104. As previously noted, the recently changed pixels correspond to one or more pixels corresponding to the person 108 that experience a change in a corresponding parameter over a determined time period. The processing subsystem 120 may determine the nature and duration of the change in the corresponding parameter experienced by the recently changed pixels for acquiring motion information corresponding to the person 108. The processing subsystem 120 may also determine if the acquired motion information corresponds to the upper region 112, the lower region 114, or a combination thereof. Specifically, the processing subsystem 120 may detect a plurality of motion events corresponding to the person 108 based on a time and a location associated with the motion information acquired from each of the recently changed pixels.

To that end, the processing subsystem 120 may include timing circuitry 306 for determining the duration of the change in the corresponding parameter experienced by the recently changed pixels. In one embodiment, the processing subsystem 120 may also include a memory 308 to store the determined duration of the change in the corresponding parameter experienced by the recently changed pixels. The memory 308 may further store a list of the recently changed pixels and corresponding parameters, the acquired motion information, and so on. Further, the processing subsystem 120 may use the motion information acquired from the recently changed pixels to detect motion events corresponding to the person 108 proximate the floor 106.

In one embodiment, the processing subsystem 120 may compute a magnitude of motion, an area of motion and a location of motion corresponding to the person 108 in the field of view 104 based on the acquired motion information. By way of example, the processing subsystem 120 may compute the magnitude of motion corresponding to the person 108 based on a count of the recently changed pixels. Further, in certain embodiments, the processing subsystem 120 may use standard trigonometric functions to compute an approximate distance of the person 108 from the DAS 102. In such embodiments, the processing subsystem 120 may consider a pixel having the lowest Y coordinate position in the recently changed pixels to be representative of a contact point of the person 108 with the floor 116, and scale the count of the recently changed pixels accordingly.

Similarly, the processing subsystem 120 may compute moving averages of each of the X and Y coordinates of the recently changed pixels to locate the person 108 in the field of view 104. Further, the processing subsystem 120 may compute the area of motion of the person 108 by identifying a geometrical shape such as a polygon enclosing the recently changed pixels. By way of example, the geometrical shape corresponding to the area of motion may be identified based on the highest and the lowest X and Y coordinate positions corresponding to the recently changed pixels.

In accordance with aspects of the present technique, the processing subsystem 120 may use the computed values of the magnitude and area of motion to determine if the detected motion corresponds to the person 108. As previously noted, the processing subsystem 120 may evaluate the approximate distance of the person 108 from the DAS 102 using one or more standard trigonometric functions that may assume the pixel having the lowest Y coordinate position in the recently changed pixels to be representative of the contact point of the person 108 with the floor 116. In certain embodiments, the functions used by the processing subsystem 120 may further depend on the lens and resolution of the DAS 102. Additionally, the processing subsystem 120 may also use these functions to determine the orientation of the person 108 in the field of view 104. The determined orientation of the person 108 in the field of view 104 indicates if the person 108 has suffered a potential fall event and is disposed on the floor 106.

Upon determining that the person 108 may have experienced a fall event, the processing subsystem 120 may generate an output through the output device 122 to alert appropriate personnel or a healthcare monitoring system. Thus, in some embodiments, the FD system 300 may be implemented as a standalone system for fall detection. In alternative embodiments, however, the FD system 300 may be implemented as part of a larger healthcare system for detecting the person 108 who may have experienced a fall event. A method for detecting a fall event by evaluating the recently changed pixels corresponding to the person 108 disposed in the field of view 104 will be described in greater detail with reference to FIG. 4.

Figure 4:
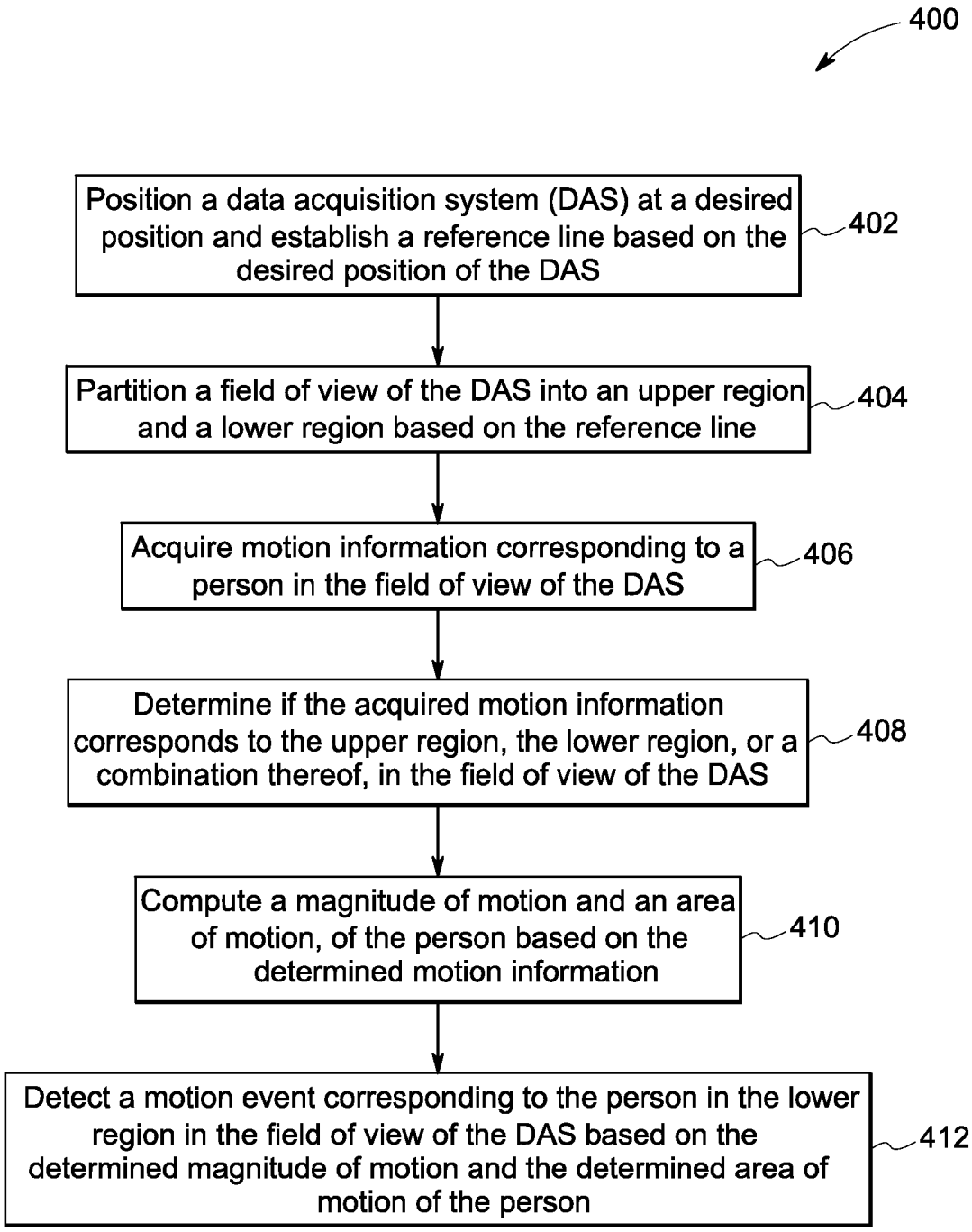
FIG. 4 is a flow chart illustrating an exemplary method for detecting motion, in accordance with aspects of the present technique.

Turning to FIG. 4, a flow chart 400 depicting an exemplary method for fall detection is presented. The exemplary method may be described in a general context of computer executable instructions. Generally, computer executable instructions may include routines, programs, objects, components, data structures, procedures, modules, functions, and the like that perform particular functions or implement particular abstract data types. The exemplary method may also be practiced in a distributed computing environment where optimization functions are performed by remote processing devices that are linked through a communication network. In the distributed computing environment, the computer executable instructions may be located in both local and remote computer storage media, including memory storage devices.

Further, in FIG. 4, the exemplary method is illustrated as a collection of blocks in a logical flow graph, which represents a sequence of operations that may be implemented in hardware, software, or combinations thereof. The various operations are depicted in the blocks to illustrate the functions that are performed generally during positioning of a DAS, partitioning of a field of view, and FD phases of the exemplary method. In the context of software, the blocks represent computer instructions that, when executed by one or more processing subsystems, perform the recited FD operations. The order in which the exemplary method is described is not intended to be construed as a limitation, and any number of the described blocks may be combined in any order to implement the exemplary method disclosed herein, or an equivalent alternative method. Additionally, individual blocks may be deleted from the exemplary method without departing from the spirit and scope of the subject matter described herein. For discussion purposes, the exemplary method is described with reference to the implementations of FIGS. 1-3.

The exemplary method aims to simplify processes and computations involved in detection of a fall event corresponding to an object such as the person 108 of FIG. 1. To that end, a DAS, such as the DAS 102 of FIGS. 1-2 is appropriately positioned to acquire data corresponding to relevant regions of the field of view such as the field of view 104 of FIG. 1.

Particularly, at step 402, the DAS is positioned at a desired position corresponding to a desired height and a desired orientation of the DAS in the field of view. Values corresponding to the desired height and the desired orientation of the DAS may be based on application requirements, such as size of the object to be monitored and dimensions corresponding to the FD environment. By way of example, the desired height of the DAS may correspond to a waist height of a person, such as about 24 inches, whereas the desired orientation may correspond to a horizontal orientation.

In accordance with aspects of the present technique, the DAS is positioned at the desired height and the desired orientation by employing a specific installation procedure. In one embodiment, the specific installation procedure includes disposing a reference device such as the reference device 118 of FIG. 1 at the desired height and the desired orientation in the field of view to facilitate appropriate positioning of the DAS. In certain embodiments, the height of the light reflected from the reference device disposed on an opposite wall is determined to be generally representative of the desired height and the desired orientation of the DAS. In alternative embodiments, the DAS determines a horizontal row of pixels corresponding to the reference device to be a threshold value of the desired height and the desired orientation of the DAS.

Further, a processing subsystem such as the processing subsystem 120 of FIG. 1 compares a current position of the DAS with the threshold value of the desired height and the desired orientation of the DAS. If the current position of the DAS differs from the threshold value by more than a determined value, an audio and/or visual output is generated and/or communicated to an output device. By way of example, the output device may include a display, a speaker, or another system that may be communicatively coupled to a FD system such as the FD system 300 of FIG. 3. Once the output is generated, the FD system may be reset either manually, or after a specific period of time. Alternatively, the FD system may be reset once a specific action is detected by the FD system. In one embodiment, the specific action includes adjusting the positioning of the DAS using a positioning subsystem such as the positioning subsystem 124 of FIG. 1. By way of example, the positioning subsystem may include one or more fastening devices such as screws or actuators coupled to the processing subsystem to adjust the current position of the DAS in accordance with the desired position upon receiving the generated output.

In certain embodiments, a reference line such as the reference line 110 of FIG. 1 is established based on the desired position of the DAS. Particularly, the reference line is established at the desired height of the DAS, thereby partitioning the field of view 104 into an upper region and a lower region at step 404. As previously noted, the lower region corresponds to those regions in the field of view where a risk associated with a potential fall event corresponding to the person may be high. The lower region, therefore, may correspond to regions such as foot of a bed, a ground or the floor of a room, whereas the upper region may correspond to the rest of the room.

Accordingly, the field of view is partitioned such that a substantial portion of high-risk movements such as a person crawling into the room or twitching on the floor may be confined to the lower region. Alternatively, the field of view may be partitioned such that at least a portion of the low-risk movements corresponding to a person lying on the bed or sitting in a chair is detected in both the upper region and the lower region, thereby preventing false alarms. In certain embodiments, the upper region and the lower region, therefore, are substantially equal in size. In other embodiments, however, the size of the upper region and the lower region may vary based on application requirements and/or user preferences.

Subsequently, at step 406, the DAS acquires motion information corresponding to the person disposed in the field of view. To that end, the DAS acquires one or more images corresponding to the person disposed in the field of view. Further, the processing subsystem processes the one or more images generated by the DAS to generate a list of one or more pixels corresponding to the person. Specifically, the processing subsystem identifies a list of recently changed pixels corresponding to the person. As previously noted, the term "recently changed pixels" corresponds to one or more pixels corresponding to the person that experience a change in a corresponding parameter over a determined time period.

By way of example, the corresponding parameter may include an X coordinate position, a Y coordinate position, a Z coordinate position, or combinations thereof, of the recently changed pixels in a positional coordinate system corresponding to the field of view. The processing subsystem further determines the nature and duration of change in the corresponding parameter experienced by the recently changed pixels to acquire motion information corresponding to the person.

Specifically, at step 408, the processing subsystem determines if the acquired motion information corresponds to the upper region and/or the lower region of the field of view. Moreover, the processing subsystem uses the acquired motion information to compute a magnitude of motion and an area of motion of the person at step 410. In one embodiment, the processing subsystem computes the magnitude of motion corresponding to the person based on a count of the recently changed pixels. As previously noted, the count of the recently changed pixels may depend upon a distance of the person 108 from the DAS 102 and a lens and a resolution of the DAS 102. Moreover, the processing subsystem computes moving averages of each of the X and Y coordinates of the recently changed pixels to compute location of the person in the field of view.

Additionally, the processing subsystem computes the area of motion of the person by identifying a geometrical shape, such as a rectangle, enclosing the recently changed pixels. In one embodiment, the geometrical shape corresponding to the area of motion is identified based on the highest and the lowest X and Y coordinate positions corresponding to the recently changed pixels. The identified X and Y coordinate positions provide boundary coordinates corresponding to the geometrical shape. In certain embodiments, a specific percentile of X and Y coordinates from each side of the geometrical shape is discarded to limit noise in computations.

Subsequently, at step 412, the computed values of the magnitude of motion and the area of motion of the person are used to detect motion events corresponding to the person disposed in the field of view. By way of example, the computed magnitude and/or the area of motion may generally be indicative of an approximate size of the person. Further, the lowest Y coordinate position corresponding to the recently changed pixels is used to determine a distance between the DAS and the person. Alternatively, standard trigonometric functions based on the lens and resolution of the DAS 102 may be used to determine the distance between the DAS and the person. The determined distance is used to mitigate perspective-based issues by generating strict qualifying criteria, such as those relating to object size, on objects that are located closer to the DAS. The generated criteria, thus, prevent a small object, such as a cat, from generating a false alarm by passing too close to the DAS. Alternatively, the generated criteria may also help to determine if the object corresponds to the person based on the approximate size of the object. Further, a vertical or a horizontal position of the person is determined based on a length and a breadth corresponding to the computed area of motion. Specifically, a horizontal position indicates the person to be disposed on the floor.

Thus, the computed values corresponding to the magnitude of motion and the area of motion of the person are used to detect specific fall events. As previously noted, the specific fall events may include a person crawling in from another room, a person twitching on the floor, a slip fall, a slow fall, and so on. Certain embodiments, therefore, employ location information corresponding to the area of motion to detect the specific fall events. By way of example, if the processing subsystem 120 determines that the area of motion was initially disposed in both the upper region and the lower region, and subsequently, only in the lower region, a slip fall event may be determined. Alternatively, if the area of motion is disposed only in the lower region, a motion event such as a person crawling in from another room, a person twitching on the floor, or a slow fall event is determined.

However, if it is determined that the area of motion was initially disposed in the lower region, and subsequently within a determined time period, in both the upper region and the lower region, no fall event may be determined. As previously noted, in embodiments relating to human fall detection, the determined time period may correspond to a recovery time during which the person may get up subsequent to a fall. By way of example, in one embodiment, the determined time period may be about 90 seconds. The determined period, however, may vary based on other parameters such as a location of the fall and/or the presence of another person in the field of view. In case, the person fails to get up within the determined time period, the FD system may generate an output such as an audio or visual alarm through an output device to alert a care-giving personnel or monitoring system regarding the fall event. The fallen person, thus, may expeditiously receive medical aid and attention.

The FD system and method disclosed hereinabove, thus, allow efficient monitoring of patients while achieving service cost reduction by using a smaller number of care-giving personnel. Particularly, the FD system allows remote monitoring and follow-up of patients and remote video for expert consultations. Thus, the exemplary FD method and system facilitate earlier discharge of patients with non-critical illnesses from a healthcare institution. Furthermore, by using a list of recently changed pixels as opposed to images corresponding to the person, the FD system effectively mitigates privacy concerns. Moreover, the complexity and the amount of processing required for detecting a fall event corresponding to a person in a particular field of view is also reduced. Accordingly, standard image capture devices such as a digital camera may be used for monitoring the field of view, thereby reducing equipment cost and complexity. Additionally, the FD system may provide an ability to adapt to different room configurations, thereby reducing setup and operation costs and effort.

Although the exemplary embodiments in the present technique are described in the context of human fall detection, use of the disclosed technique for detecting other kinds of objects such as pets and toys that continue to move subsequent to a fall is also contemplated.

While only certain features of the present invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method for detecting motion, comprising:

positioning a data acquisition system at a desired position and establishing a reference line based on the desired position of the data acquisition system;

partitioning a field of view of the data acquisition system into an upper region and a lower region based on the reference line;

acquiring motion information corresponding to a person in the field of view of the data acquisition system based on a plurality of pixels that experiences a change in a corresponding parameter;

determining if the acquired motion information corresponds to the upper region, the lower region, or a combination thereof, in the field of view of the data acquisition system based on the plurality of pixels that experiences a change in a corresponding parameter;

computing a duration of motion, a magnitude of motion and an area of motion of the person in the upper region, the lower region, or a combination thereof, based on the plurality of pixels that experiences a change in a corresponding parameter; and detecting a type of fall event corresponding to the person based on the computed duration of motion, the magnitude of motion and the computed area of motion of the person in the upper region, the lower region, or a combination thereof.

2. The method of claim 1, wherein positioning the data acquisition system at the desired position comprises positioning the data acquisition system at a desired height and a desired orientation with respect to a reference device for establishing the reference line.

3. The method of claim 2, wherein the desired orientation corresponds to one of a horizontal orientation or a vertical orientation.

4. The method of claim 2, wherein positioning the data acquisition system comprises:

disposing the reference device at the desired height and the desired orientation; and positioning the data acquisition system based on the desired height and the desired orientation of the reference device.

5. The method of claim 4, wherein positioning the data acquisition system further comprises generating an output based on the desired height and the desired orientation of the data acquisition system.

6. The method of claim 5, wherein generating the output comprises generating an audio output, a visual output, or a combination thereof.

7. The method of claim 1, wherein acquiring the motion information corresponding to the person in the field of view of the data acquisition system comprises identifying a plurality of pixels that experience a change in a corresponding parameter.

8. The method of claim 7, wherein the corresponding parameter associated with each pixel in the plurality of pixels comprises an X coordinate position, a Y coordinate position, a Z coordinate position, or combinations thereof, of that pixel.

9. The method of claim 8, further comprising determining a duration of the change in the corresponding parameter experienced by each of the plurality of pixels disposed in the upper region, the lower region, or a combination thereof.

10. The method of claim 9, wherein computing the magnitude of motion, comprises determining a count of the plurality of pixels that experiences a change in a corresponding parameter.

11. The method of claim 10, wherein computing the area of motion comprises identifying a geometrical shape enclosing the plurality of pixels that experiences a change in a corresponding parameter.

12. The method of claim 11, wherein identifying the geometrical shape comprises determining a highest X coordinate position, a highest Y coordinate position, a lowest X coordinate postion, and a lowest Y coordinate postion corresponding to the plurality of pixels that experiences a change in a corresponding parameter.

13. The method of claim 12, further comprising determining a distance between the data acquisition system and the person based on the lowest Y coordinate postion corresponding to the plurality of pixels that experiences a change in a corresponding parameter.

14. The method of claim 13, further comprising determining an approximate size of the person based on a length corresponding to the area of motion, a width corresponding to the area of motion, the determined distance between the data acquisition system and the person, or combinations thereof.

15. The method of claim 14, further comprising determining a horizontal position or a vertical position corresponding to the person based on the length corresponding to the area of motion and the width corresponding to the area of motion.

16. The method of claim 15, further comprising generating an output based on the determined horizontal position of the person and the determined approximate size of the person.

17. The method of claim 1, wherein detecting a motion event corresponding to the person in the lower region of the field of view of the data acquisition system comprises detecting a fall event.

18. The method of claim 1, further comprising:

detecting lighting conditions corresponding to the field of view of the data acquisition system; and activating a lighting device based on the detected lighting conditions.

19. The method of claim 1, wherein the field of view comprises a horizontal plane, a vertical plane, an inclined plane, or combinations thereof.

20. A fall detection system, comprising:

a data acquisition system that acquires a plurality of pixels that experiences a change in a corresponding parameter in a field of view of the data acquisition system, wherein the plurality of pixels corresponds to a person;

a positioning subsystem that positions the data acquisition system at a desired position and establishes a reference line based on the desired position of the data acquisition system; and a processing subsystem communicatively coupled to the data acquisition system, wherein the processing subsystem:

partitions a field of view of the data acquisition system into an upper region and a lower region based on the reference line;

acquires motion information corresponding to the person in the field of view of the data acquisition system based on a plurality of pixels that experiences a change in a corresponding parameter;

determines if the acquired motion information corresponds to the upper region, the lower region, or a combination thereof, in the field of view of the data acquisition system;

computes a duration of motion, a magnitude of motion and an area of motion of the person in the upper region, the lower region, or a combination thereof, based on the plurality of pixels that experiences a change in a corresponding parameter using the acquired motion information; and detects a type of a fall event corresponding to the person in the field of view of the data acquisition system based on the computed duration of motions, magnitude of motion and the computed area of motion of the person in the upper region, the lower region, or a combination thereof.

21. The system of claim 20, wherein the data acquisition system comprises a camera, a motion sensor, an optical sensor, or combinations thereof.

22. The system of claim 21, further comprising a lighting device communicatively coupled to the data acquisition system, wherein the lighting device is activated based on ambient lighting conditions in the field of view of the data acquisition system.

23. The system of claim 22, wherein the motion sensor detects motion in the field of view of the data acquisition system and activates the lighting device based on the detected motion.

24. The system of claim 20, wherein the positioning subsystem comprises one or more fastening devices, a reference device disposed at the desired position in the field of view of the data acquisition system, or a combination thereof.

25. The system of claim 20, further comprising timing circuitry that determines a time period corresponding to the change in the corresponding parameter experienced by the plurality of pixels disposed in the upper region, the lower region, or a combination thereof.

26. The system of claim 20, further comprising an output unit that generates an output upon detecting the fall detection event corresponding to the person in the field of view of the data acquisition system.

27. The system of claim 26, wherein the output unit comprises an alarm unit, an audio transmitter, a video transmitter, a display unit, or combinations thereof.

* * * * *